United States Patent [19]

Juelg, Jr.

[11] Patent Number: 4,905,397

[45] Date of Patent: Mar. 6, 1990

[54] ARROW WITH STOP

[75] Inventor: James E. Juelg, Jr., Corpus Christi, Tex.

[73] Assignee: Wade L. Grassedonio, Corpus Christi, Tex. ; a part interest

[21] Appl. No.: 292,905

[22] Filed: Jan. 3, 1989

[51] Int. Cl.[4] ..... F41B 5/02

[52] U.S. Cl. ..... 43/6; 273/416; 273/419

[58] Field of Search ..... 43/6; 273/416, 419, 273/420, 421

[56] References Cited

U.S. PATENT DOCUMENTS

| | | | |
|---|---|---|---|
| 1,133,189 | 3/1915 | Shannon | 43/6 |
| 2,135,414 | 11/1938 | Shores | 43/6 |
| 2,770,905 | 11/1956 | Efraimson | 43/6 |
| 3,036,395 | 5/1962 | Nelson | 43/6 |
| 3,282,262 | 11/1966 | Skinner | 273/416 |
| 3,945,642 | 3/1976 | Henthorn | 43/6 |
| 4,111,424 | 9/1978 | Schreiber | 273/416 |

*Primary Examiner*—Nicholas P. Godici
*Assistant Examiner*—Mike Starkweather
*Attorney, Agent, or Firm*—G. Turner Moller

[57] ABSTRACT

A game or fish stop comprises a block of rubber-like material having a passage therethrough frictionally gripping an arrow shaft adjacent the point end. One embodiment includes a forward frustoconical face and a second embodiment includes a forward planar face. The passage includes an enlarged forward end at least as large as the arrow shaft and a substantially smaller rearward end.

14 Claims, 1 Drawing Sheet

ARROW WITH STOP

This invention relates to an arrow having a stop to prevent it from passing completely through an animal or fish which is shot.

For most kinds of archery hunting, an arrow will not pass completely through a game animal. Even if the arrow did pass completely through the animal, it is not a big deal because the animal will die shortly and both the animal and arrow can be found.

This is not true with certain types of bird hunting, such as for turkey. If the arrow passes completely through the turkey, the turkey runs or flies off and can't be found, even if it is mortally wounded. Thus, game stops are available for use on arrows when turkey hunting so the turkey will be unsuccessful in running or flying off. These game stops come in two known varieties: (1) a device similar to a Ninja dart having a plurality of pointed projections extending away from a central hub providing an opening which is received in a threaded connection between the arrow shaft and a screw-on broadhead point; and (2) a metallic device comprising a central metallic ring having a plurality of spring fingers wound, at one end, about the ring and projecting radially therefrom. In this latter type device, the central metallic ring is precisely made to fit a particular arrow size and accordingly is frictionally fit on the arrow shaft. The metallic ring is so precisely made that it will not fit arrows of slightly different diameter. This device is shown in U.S. Pat. No. 3,027,153.

Other disclosures of arrows having game and/or fish stops are found in U.S. Pat. Nos. 3,153,875 and 3,945,642. Disclosures of more general interest are found in U.S. Pat. Nos. 2,289,284; 2,568,417; 3,036,396; 3,164,385; 4,209,929; 4,380,340; 4,642,929; and 4,742,637.

One of the aggravations of bow fishing is that one loses so many arrows. Once in a great while, one misses the fish and the arrow and/or fishing line becomes entangled with brush or the like below the fish and cannot be retrieved. Much more often, the bow fisher hits the fish, but the arrow passes completely through it which means that the fishing line also passes through the fish. Even though the fish is mortally wounded, it may have sufficient life left to seek cover and wrap the line around underwater debris, such as a stump. One popular bow fishing target, known as an alligator gar, has scales which are sufficiently strong and sharp that it can cut the fishing line extending through the hole in the gar. Thus, fishing arrows are quite often lost.

In this invention, fishing arrows are provided with a small block of rubber-like material having a passage therethrough frictionally gripping the arrow shaft. The fit between the block and the arrow is sufficiently close that the arrow needs to be wet to allow the block to be forced over the nock end of the arrow. Because the block is resilient, it can be used on arrows of slightly different size.

In summary, this invention comprises an arrow including a shaft having a point at one end, a bow string notch at the other end and a game stop, on the shaft adjacent the point, including a block of resilient rubber-like material having a passage therethrough frictionally gripping the shaft. The arrow preferably has fishing arrow characteristics, i.e. it has no fletches or feathers adjacent the notch end, it connects to a fishing line mounted on a reel carried by the bow, and it may provide a pair of pivotal levers or blades for movement from a first retracted position when the arrow is shot to an expanded position preventing a fish from moving off the point end of the arrow.

It is accordingly an object of this invention to provide an arrow having an improved game or fish stop thereon.

Another object of this invention is to provide an improved game stop for hunting and fishing arrows.

A further object of this invention is to provide an arrow having an improved game or fish stop which is simple and inexpensive to manufacture, which substantially prevents the arrow from passing through an animal or fish and which is easy to position and remove from an arrow.

Other objects and advantages of this invention will become more fully apparent as this description proceeds, reference being made to the accompanying drawings and appended claims.

Figure 1:
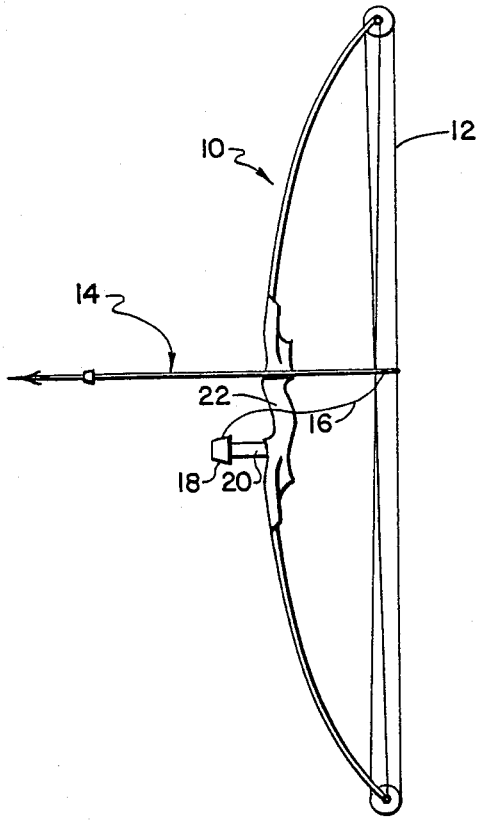
FIG. 1 is a side view of a typical fishing bow equipped with a fishing arrow of this invention.

Referring to FIGS. 1–4, there is illustrated a bow fishing rig comprising a more-or-less conventional compound bow 10 including a string 12 receiving the notched end of a fishing arrow 14 having a fishing line 16 connected to the arrow 14 and wrapped on the end of a closed face spinning reel 18 mounted on a fixture 20 secured to the bow 10 immediately below the hand grip 22. The bow 10, string 12, reel 18 and fixture 20 may be of any suitable type because these components are wholly conventional.

Figure 2:
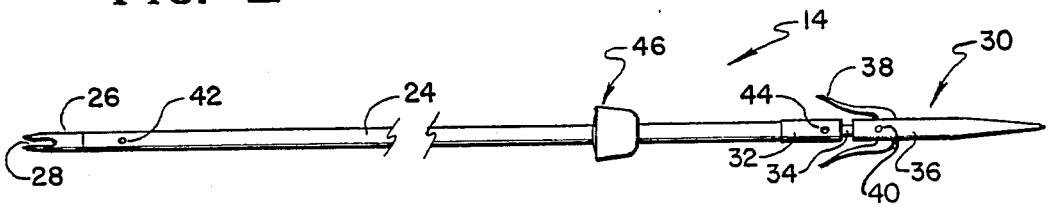
FIG. 2 is an enlarged broken view of the fishing arrow of this invention.

The arrow 14 comprises a shaft 24 of any suitable material such as wood, aluminum or fiberglass having a nock 26 at one end providing a bow string notch 28. A point 30 at the other end of the shaft 24 may be of any suitable type and preferably is a fishing point including a fitting 32 glued or otherwise secured to the shaft end. The fitting 32 includes a threaded extension 34 received in a central shank 36 having a pair of levers or blades 38 pivotally connected to the shank 36 by a pivot pin 40. The levers 38 normally partially lay in a pair of slots (not shown) in the central shank 36 and are movable between a retracted position in the slots to an expanded position as shown in FIG. 2.

Thus, the point 30 is capable of passing through the fish but when the fishing line 16 is retracted, as by operation of the spinning reel 18, the levers 38 expand and prevent the fish from coming off the end of the arrow 14. When the fish is in the boat, the central shank 36 is unthreaded relative to the extension 34. This moves an abutment (not shown) adjacent the ends of the blades 38 to allow them to move to a forward position adjacent the forward end of the point 30. Thus, the point 30 can be pulled through the fish. The construction and operation of the point 30 will be recognized by those skilled in the art to be typical of a conventional fishing point.

The fishing line 16 is connected to the arrow 14 in any suitable fashion, as by passing the free end of the line 16 through a passageway 42 in the arrow 14 adjacent the nock end and then knotted. In the alternative, the free end of the line 16 may extend in a passageway 44 provided by the fitting 32 and then knotted. Those skilled in the art will recognize the arrow 14 as being representative of presently available fishing arrows.

As mentioned previously, one of the problems in bow fishing is losing arrows caused by the arrow passing wholly through the fish and then being cut or entangled in brush or the like. In this invention, a fish stop is provided on the end of the arrow at a location sufficiently far from the levers 38 to allow them to clear the fish impaled by the arrow 14. Preferably, the fish stop is simple, inexpensive, effective and does not include sharp edges or ends which can snag the user or user's clothing.

Figure 4:
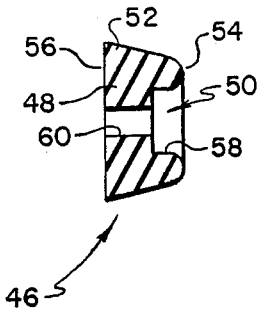
FIG. 4 is an enlarged longitudinal crosssectional view of the game or fish stop of FIGS. 1–3 illustrated in an unstressed condition prior to placement on the arrow.
Figure 3:
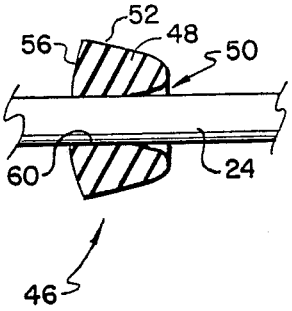
FIG. 3 is an enlarged longitudinal cross-sectional view of the game or fish stop of this invention.

To these ends, there is provided a fish stop 46 shown best in FIGS. 2–4 comprising a block 48 of rubber-like material having a passage 50 therethrough frictionally gripping the arrow shaft 24. The term rubber-like is used to describe a material having the properties of rubber, especially elasticity. The block 48 is preferably a hard rubber having a Shore A durometer hardness of about 55–85 and ideally is about 70–80. The block 50 includes a front face including a frustoconical section 52 and a curvilinear leading edge or section 54 merging between the frustoconical section 52 and the passage 50. The block 50 has a back face 56 which is generally planar in the unstressed condition shown in FIG. 4 but which assumes a slightly convex configuration as shown in the stressed condition of FIG. 3.

The passage 50 through the block 46 is preferably of unusual shape having a first section 58 which, in the unstressed condition of FIG. 4, is about the same size or preferably larger than the cross-sectional size or diameter of the arrow shaft 24 and a second section 60 which is substantially smaller than the cross-sectional size or diameter of the arrow shaft 24. For use on an arrow having a diameter of 3/16" inches, the passage section 58 is about 0.37 inches and the passage section 60 is about 0.20 inches. The nock end of the arrow 14 is inserted into the large passage section 58 which simplifies placing the fish stop 46 on the arrow shaft 24. Preferably, the fit between the block 46 and arrow shaft 24 is so close that the arrow shaft 24 needs to be wet to pass through the block 48.

As shown in FIG. 3, the shape of the passage 50 is distorted by the arrow shaft 24. The large passage section 58 remains larger than the diameter of the arrow shaft 24, but is significantly closer in size than in the condition of FIG. 4. The reason is that the small passage section 60 has been enlarged by the shaft 24 and the rubber-like material of the block 48 has been distorted to partially close the large passage section 58.

In use, the bow fisher pushes the fish stop 46 onto the arrow shaft 24 before knotting the line 16 through the passage 42, preferably after wetting the shaft 24. The fish stop 46 is pushed forwardly to a location 4–6" behind the free ends of the blades 38. The arrow 14 is placed on the hand grip 22 and the notch 28 placed on the bow string 12. Upon seeing a target fish in the water, the bow fisher draws back the bow string 12, aims the arrow 14 at the fish and releases the arrow 14. The arrow 14 hopefully impales the target fish. The forward face of the fish stop 46 is of a size to prevent the arrow 14 from passing completely through the target fish. Because the block 48 is frictionally gripping the wet arrow shaft 24, some rearward movement of the fish stop 46 occurs. Wear of the passage section 60 is readily noticed because greater rearward movement of the fish stop 46 is seen. When excessive movement occurs, the used fish stop 46 is removed and replaced with a new one.

Figure 7:
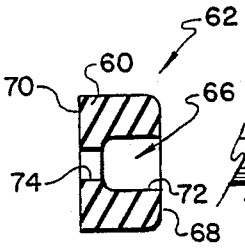
FIG. 7 is an enlarged longitudinal cross-sectional view of the game or fish stop of FIGS. 5 and 6 illustrated in an unstressed condition prior to placement on the arrow.
Figure 6:
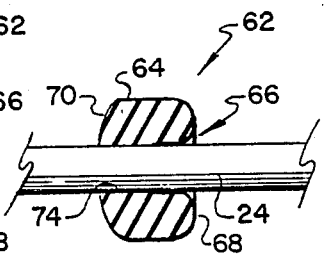
FIG. 6 is an enlarged longitudinal cross-sectional view of another embodiment of the game or fish stop of this invention.
Figure 5:
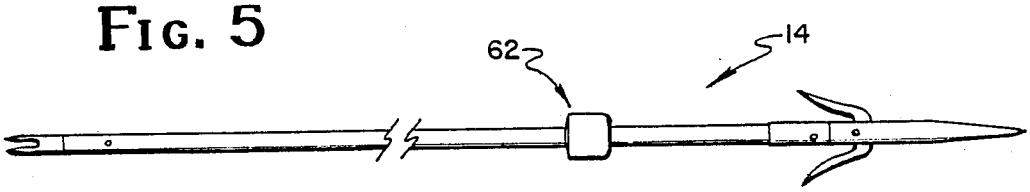
FIG. 5 is a view similar to FIG. 2 of another embodiment of this invention.

FIGS. 5–7 show another embodiment of this invention comprising the same arrow 14 having a fish stop 62 of somewhat different configuration. The fish stop 62 comprises a block 64 of rubber-like material having a passage 66 therethrough frictionally gripping the arrow shaft 24. The block 64 includes a generally planar front face 68 and a back face 70 which is generally planar in the unstressed condition shown in FIG. 7 but which assumes a slightly convex configuration as shown in the stressed condition of FIG. 6.

The passage 66 through the block 64 is preferably of unusual shape having a first section 72 which, in the unstressed illustration of FIG. 7, is substantially larger than the cross-sectional size or diameter of the arrow shaft 24 and a second section 72 which is substantially smaller than the cross-sectional size or diameter of the arrow shaft 24. The nock end of the arrow 14 is inserted into the large passage section 72 which simplifies placing the fish stop 62 on the arrow shaft 24. Preferably, the fit between the block 64 and arrow shaft 24 is so close that the arrow shaft 24 needs to be wet to pass through the block 64.

As shown in the stressed or operative position of FIG. 6, the shape of the passage 66 is distorted by the arrow shaft 24. The large passage section 72 is still larger than the diameter of the arrow shaft 24, but is significantly closer in size than in the unstressed condition of FIG. 7. The reason is that the small passage section 74 has been enlarged by the shaft 24 and the rubber-like material of the block 64 has been distorted to partially close the large passage section 72.

In use, fish stops 46, 64 work in the same fashion. The fish stop 64 is believed to have greater resistance to penetrating target fish because the forward face presents greater surface area contacting the fish at the moment of impact.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An arrow comprising a shaft having a point of first cross-sectional size at a first end, a string notch at a second end and a game stop of second cross-sectional size larger than the first cross-sectional size adjacent the first end including a block of resilient rubber-like material having a passage therethrough frictionally gripping the shaft, the resilient rubber-like material having a Shore durometer hardness of about 55–85.

2. The arrow of claim 1 wherein the block is entirely of the rubber-like material and the rubber like material has a Shore durometer hardness of about 70–80.

3. The arrow of claim 1 wherein the point includes a central shank and a plurality of levers pivotally connected to the shank for movement about an axis from a first retracted position generally parallel to the shank where the levers reside between the axis and the notch to a second expanded position transverse to the central shank.

4. The arrow of claim 3 further comprising a fishing line connected at one end to the arrow and for connection at an opposite end to a reel on a bow.

5. The arrow of claim 4 wherein the shaft provides a passageway therethrough and the fishing line extends through the passageway and provides a knot securing the line in the passageway.

6. The arrow of claim 5 wherein the shaft is free of fletches adjacent the bow string notch.

7. The arrow of claim 1 wherein the block of rubber-like material includes a first front face transverse to the shaft facing the point ad a second face facing the notch, the passage providing communication between the first and second faces.

8. The arrow of claim 7 wherein the first face is generally planar.

9. The arrow of claim 7 wherein the second face is generally planar.

10. The arrow of claim 1 wherein the shaft is of a predetermined cross-sectional size adjacent the first end and the passage is less than the predetermined size.

11. The arrow of claim 1 wherein the shaft is of a first predetermined diameter adjacent the first end and the passage is of a second predetermined diameter less than the first diameter.

12. An arrow comprising a shaft having a point at a first end, a string notch at a second end and a game stop adjacent the first end including a block of resilient rubber-like material having a first front face transverse to the shaft facing the point, a second face facing the notch, and a passage providing communication between the first and second faces and frictionally gripping the shaft, the first face including a first frustoconically shaped section and a second curvilinear section merging between the first section and the passage.

13. An arrow comprising a shaft having a point at a first end, a string notch at a second end and a game stop adjacent the first end including a block of resilient rubber-like material having a first front face transverse to the shaft facing the point, a second face facing the notch, and a passage providing communication between the first and second faces and frictionally gripping the shaft, the passage, in an unstressed condition of the block of rubber-like material, providing a first section having a cross-sectional size larger than the cross-sectional size of the shaft and a second section having a cross-sectional size smaller than the cross-sectional size of the shaft.

14. The arrow of claim 3 wherein the passage, in a stressed condition of the block of rubber-like material, includes a first section having a cross-sectional size larger than the cross-sectional size of the shaft and a second section having a cross-sectional size smaller than the cross-sectional size of the shaft.

* * * * *